US011529815B2

(12) United States Patent
Hachmann

(10) Patent No.: US 11,529,815 B2
(45) Date of Patent: Dec. 20, 2022

(54) METHOD FOR PRETREATING A PRINTING MATERIAL FOR INK JET PRINTING

(71) Applicant: HEIDELBERGER DRUCKMASCHINEN AG, Heidelberg (DE)

(72) Inventor: Peter Hachmann, Weinheim-Hohensachsen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 630 days.

(21) Appl. No.: 16/034,468

(22) Filed: Jul. 13, 2018

(65) Prior Publication Data

US 2019/0016157 A1 Jan. 17, 2019

(30) Foreign Application Priority Data

Jul. 13, 2017 (DE) ..... 102017212015.0

(51) Int. Cl.
*B41J 11/00* (2006.01)
*B41M 5/00* (2006.01)
*B41J 3/38* (2006.01)

(52) U.S. Cl.
CPC ..... *B41J 11/0015* (2013.01); *B41J 3/38* (2013.01); *B41M 5/0011* (2013.01); *B41M 5/0017* (2013.01)

(58) Field of Classification Search
CPC ..... B41J 11/0015; B41J 3/38; B41J 2/005; B41M 5/0011; B41M 5/0017; B41M 1/24; B41M 1/36; B41M 5/00
See application file for complete search history.

(56) References Cited

U.S. PATENT DOCUMENTS

| | | | | |
|---|---|---|---|---|
| 6,649,249 | B1 | 11/2003 | Engle et al. | |
| 8,541,063 | B2 | 9/2013 | Kawakami et al. | |
| 8,789,925 | B1 | 7/2014 | Thompson | |
| 9,376,582 | B1 * | 6/2016 | Dannhauser | B41M 5/0047 |
| 9,662,889 | B2 | 5/2017 | Zhang et al. | |
| 2004/0191688 | A1 | 9/2004 | Mizushima | |
| 2008/0199631 | A1 | 8/2008 | Makuta et al. | |

(Continued)

FOREIGN PATENT DOCUMENTS

| | | |
|---|---|---|
| CN | 1353647 A | 6/2002 |
| CN | 1538423 A | 10/2004 |

(Continued)

*Primary Examiner* — Henok D Legesse
(74) *Attorney, Agent, or Firm* — Laurence A. Greeberg; Werner H. Stemer; Ralph E. Locher

(57) ABSTRACT

A method pretreats a printing material used for ink printing to influence the spreading of ink print dots on the printing material. The spreading behavior is influenced in such a way that the ink print dots spread in an anisotropic way. The anisotropic spreading advantageously allows undesired quality losses in the print that are caused by a failed ink nozzle to be reduced or avoided. The influencing of the spreading behavior may be achieved by an anisotropic application of a liquid, in particular a primer or varnish, to the printing material, or by an anisotropic embossment or print on the printing material or by an anisotropic treatment of the printing material with charged particles, in particular by a plasma or a corona, or with electromagnetic radiation, in particular laser radiation.

12 Claims, 3 Drawing Sheets

(56) References Cited

U.S. PATENT DOCUMENTS

| | | | | |
|---|---|---|---|---|
| 2009/0133169 | A1 | 5/2009 | Mirkin et al. | |
| 2009/0237442 | A1* | 9/2009 | Yamanobe | C09D 11/54 347/21 |
| 2010/0053236 | A1 | 3/2010 | Ooishi et al. | |
| 2016/0052302 | A1* | 2/2016 | Willems | C09D 11/322 347/101 |
| 2018/0147871 | A1* | 5/2018 | Landa | B41F 19/005 |

FOREIGN PATENT DOCUMENTS

| | | | |
|---|---|---|---|
| CN | 104417064 | A | 3/2015 |
| DE | 102014201050 | A1 | 8/2014 |
| EP | 1955858 | A1 | 8/2008 |
| EP | 1958782 | A1 | 8/2008 |

* cited by examiner

METHOD FOR PRETREATING A PRINTING MATERIAL FOR INK JET PRINTING

CROSS-REFERENCE TO RELATED APPLICATION

This application claims the priority, under 35 U.S.C. § 119, of German application DE 10 2017 212 015.0, filed Jul. 13, 2017; the prior application is herewith incorporated by reference in its entirety.

BACKGROUND OF THE INVENTION

Field of the Invention

The present invention relates to a method for pretreating a printing material for ink jet printing to influence the spreading of ink print dots on the printing material.

The technical field of the invention is the field of the graphic arts industry and in particular the field of industrial ink jet printing on flat substrates, i.e. the field of applying liquid ink to sheet-shaped or web-shaped printing materials, preferably made of paper, cardboard, or plastic.

In the known DOD (drop-on-demand) ink printing methods, liquid ink is applied and a print is created on a flat printing substrate by an ink printing head (in short: head) with individually controllable nozzles that generate tiny ink droplets, preferably in a picoliter range, and transfer them to the printing substrate in a touch-free way as print dots in accordance with the image to be printed. The nozzles may be actuated by piezoelectric actuators.

In general, every head has a plurality of individually controllable nozzles. In general, the nozzles are disposed in one or more rows of nozzles that are parallel to (or slightly inclined relative to) the direction of transport of the printing material. When actuated, every nozzle generates an ink drop. When a nozzle is continuously actuated, it prints a visible line in the color of the ink onto the printing material.

On the other hand, a visible line may occur if a nozzle does not work properly, for instance because its nozzle opening is blocked by solidified ink. As the failed nozzle consistently does not produce any ink drops, the printing material color, usually white, will become visible as a white line in the print. Such undesired stripes (also referred to as "missing nozzle" or "missing line") affect the quality of the print and thus the quality of the printed product.

Published, European patent applications EP1955858 A1 (corresponding to U.S. Pat. No. 8,541,063) and EP1958782 A1 (corresponding to U.S. patent publication No. 2008/019962) describe liquids that are applied to the entire surface of the substrate before ink is applied; they have an influence on the spreading behavior of the ink drops on the substrate. U.S. patent publication No. 2010053236 A1 discloses the application of an aqueous precoat over the entire surface to influence the spreading behavior.

SUMMARY OF THE INVENTION

Against this background, an object of the present invention is to provide a method that overcomes the disadvantages of the prior art and improves the quality of a print to be created and thus of the printed product and in particular reduces or avoids the formation of undesired stripes caused by failed nozzles.

In accordance with the invention, this object is attained by a device as recited in the main claim. Advantageous and thus preferred further developments of the present invention will become apparent from the dependent claims as well as from the description and drawings.

The invention relates to a method for pretreating a printing material for ink printing wherein the spreading behavior of ink print dots on the printing material is influenced. The method is characterized in that the spreading behavior is influenced in such a way that the ink print dots spread in an anisotropic way.

The invention advantageously allows the quality of the printed image and thus of the printed product to be improved, in particular to reduce or avoid the formation of undesired stripes caused by failed nozzles.

A preferred further development of the invention may be characterized in that the spreading behavior is influenced by an anisotropic application of a liquid, in particular a primer or varnish, to the printing material. The application may be achieved by at least one print head (similar to or identical with an ink print head). The varnish may be a UV varnish and may be pinned, in particular if UV-curable inks are used. The primer may be what is referred to as a precoat (containing water and an acid), in particular if water-based inks are used.

A preferred further development of the invention may be characterized in that the spreading behavior is influenced by an anisotropic embossment or print on the printing material. The embossment or print may be created by an anisotropic embossing or printing plate, in particular a flexographic printing plate (or a lithographic offset or gravure plate). The embossment may in particular be a micro-embossment, i.e. an embossment of structures in an order of magnitude of between 0.1 μm and 10 μm, in particular structures of approximately 1 μm in terms of size (e.g. line width) and spacing. The anisotropic spreading influenced by the embossment may, for instance, be attained by a capillary effect of the embossment structures on the ink. In flexographic printing, line widths and spacings of approximately 6 μm may be created.

A preferred further development of the invention may be characterized in that the spreading behavior is influenced by an anisotropic treatment of the printing material with charged particles, in particular with a plasma or a corona, or with electromagnetic radiation, in particular laser radiation. By laser radiation, line widths and spacings of approximately 1 μm or less may be created.

A preferred further development of the invention may be characterized in that the spreading behavior is influenced in such a way that the transverse spreading behavior in a direction essentially perpendicular to a side edge of the printing material is increased relative to the longitudinal spreading behavior in a direction essentially parallel to the side edge. Advantageously, a provision may be made for the increased transverse spreading to be factored in as early as at a preprint stage when print data are generated for the ink print heads inasmuch as the widening of the print dots (and thus of longitudinal lines, for instance) correlated with the transverse spreading is compensated for. Advantageously, a provision may be made for print dots to be printed closer together in a longitudinal direction (or to reduce the printing material transport speed in a corresponding way) to counteract undesired ("white") transverse lines that may occur as a result of the transverse spreading.

A preferred further development of the invention may be characterized in that the spreading behavior is influenced in such a way that the transverse spreading behavior in a direction essentially perpendicular to a side edge of the printing material is reduced relative to the longitudinal spreading behavior in a direction essentially parallel to the side edge.

A preferred further development of the invention may be characterized in that the spreading behavior is influenced in such a way that the longitudinal spreading behavior in a direction essentially parallel to a side edge of the printing material is increased relative to the transverse spreading behavior in a direction essentially perpendicular to the side edge.

A preferred further development of the invention may be characterized in that the spreading behavior is influenced in such a way that the longitudinal spreading behavior in a direction essentially parallel to a side edge of the printing material is reduced relative to the transverse spreading behavior in a direction essentially perpendicular to the side edge.

A preferred further development of the invention may be characterized in that the side edge is aligned to be parallel to a direction of transport of the printing material.

Other features which are considered as characteristic for the invention are set forth in the appended claims.

Although the invention is illustrated and described herein as embodied in a method for pretreating a printing material for ink jet printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
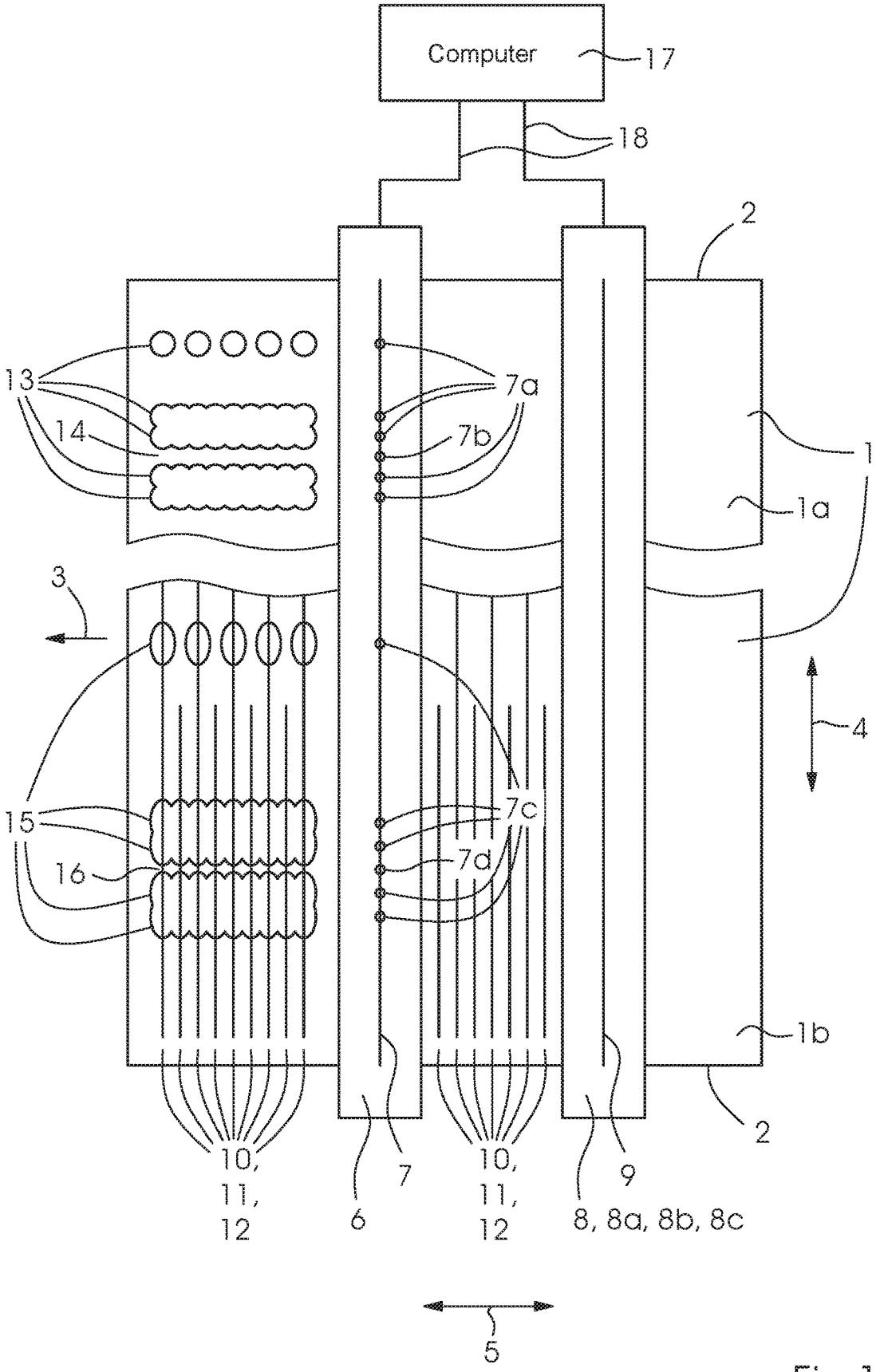
FIG. 1 is an illustration of an exemplary embodiment of a method of the invention and a device for carrying out the method of the invention.

Referring now to the figures of the drawings in detail and first, particularly to FIG. 1 thereof, there is shown a preferred exemplary embodiment of a method of the invention. At the same time, FIG. 1 illustrates a preferred exemplary embodiment of a preferred device carrying out the method of the invention.

A printing material 1, e.g. paper, cardboard, or a foil, has side edges 2. The printing material is conveyed along a device in a direction of transport 3. The device may be part of an ink printing machine and may comprise at least one transport element for transporting the printing material, in particular a transport cylinder or a transport belt. A transverse direction 4 is perpendicular to the side edges 2; a longitudinal direction 5 is parallel to the side edges 2.

The device suitable for implementing the method of the invention contains an ink print head 6 with a row of individually controllable nozzles 7 (disposed to be essentially parallel to the transverse direction). The ink print head may be configured as an assembly of multiple neighboring heads as what is known as a print bar, and may in particular extend over the width of the printing material 1 (measured in the transverse direction 4); in short, it may be as wide as a page. For a better understanding of the invention, individual nozzles 7*a* to 7*d* of the head 6 are shown at an enlarged scale.

The device further contains an element 8 for pretreating the printing material 1. The element 8 may for instance be a print head 8*a* for treatment liquid or an embossing or printing device 8*b* (or a plasma or corona device or a laser 8*c*). Like the print head 6, the device 8 may be as wide as a page. The preferred embodiment including a print head 8*a* will be described below. In a way similar to print head 6, such a print head 8*a* includes individually controllable nozzles 9 disposed in a row. The treatment liquid may be ink, in particular colorless or white ink, or a primer (e.g. what is known as a "precoat"), in particular a varnish or a liquid containing water and an acid for reacting with the ink.

The printing material 1 shown in FIG. 1 has a first region 1*a* and a second region 1*b*. In the first region, the element 8 is inactive; consequently, the spreading behavior is not influenced. In the second region, the device 8 is active; consequently, the spreading behavior is influenced in such a way that the ink print dots spread in an anisotropic way. The two regions are shown to be next to one another (solely for understanding the invention) to visualize the effect of the method of the invention. Under production conditions, the element 8 will preferably treat the entire surface of the printing material 1 instead.

As shown in FIG. 1, the element 8 creates an anisotropic structure 10 in the second region 1*b*, in particular lines of a specific width and spacing. The anisotropic structure is preferably created by a liquid 11 applied by the element 8/8*a*. Alternatively, the anisotropic structure 10 may be created as an embossment/print/plasma/corona/laser structure 12, i.e. as a structure that is created by embossing, printing, plasma treatment, corona treatment, and/or laser treatment.

As shown in the first region 1*a*, the nozzles 7*a* are actuated to create ink drops and consequently ink print dots 13 on the printing material 1. Additionally, it can be seen that the ink print dots of adjacent nozzles 7*a* run together on the printing material 1 to form a continuous ink surface due to the spreading of the ink.

Nozzle 7*b* is likewise actuated separately, but it is an example of a defective nozzle or one that has been blocked by solidified ink. Thus nozzle 7*b* creates no ink drop and thus no ink print dot 13. The failure of nozzle 7*b* results in a visible white line 14 extending in a longitudinal direction 5. If black ink is printed onto white paper, for instance, a white line 13 would be visible in a black environment. This is an undesired phenomenon. Without limiting the invention in any way, please note that the exemplary embodiment assumes that a white printing material is used, resulting in a potentially visible white line.

In the second region 1*b*, it is shown that nozzles 7*c* are actuated to create ink drops and ink print dots 15 on the printing material 1. In addition, it is visible that the ink print dots of adjacent nozzles 7*c* run into one another on the printing material 1 to form a continuous ink surface due to the spreading of the ink.

In the second region 1*b*, the spreading behavior of the ink print dots 15 is influenced by the anisotropic structure 10 that has been created. The ink print dots spread in an anisotropic way; for instance, their spreading behavior in the longitudinal direction 5 differs from that in the transverse direction 4 (in the illustrated example, the print dots become essentially elliptical). In the illustrated example, the transverse spreading behavior of the ink print dots 15 is increased relative to the longitudinal spreading behavior. This increase may be caused, for instance, by a liquid 11 that is applied by the device 8 in an anisotropic way to attain increased transverse spreading.

Nozzle 7*d* in the second region 1*b* is an example of a missing nozzle that does not create any print dot 15. However, it can be seen that the white line 16 is closed because of the increased transverse spreading behavior. Line 16 in FIG. 1 is not shown as a completely closed or covered line to illustrate the closing of the line and the position thereof. In a preferred case, the transverse spreading behavior is influenced in such a way, however, that the entire line 16 is covered and no longer visible as a white line, for instance.

The top of the two regions 1*a* and 1*b* ("top" with respect to FIG. 1) illustrates drops applied to create print dots 13/15 spaced apart from one another in a longitudinal direction. This illustration is only used to explain the invention and to show how individual print dots (without direct neighbors) behave with and without the influencing of the spreading behavior in accordance with the invention. The print dots shown in region 1*a* have a size (average diameter) of approximately 40 μm. The anisotropic structures (lines) shown in regions 1*a* and 1*b* have a line width of preferably between approximately 10 μm and approximately 20 μm and are spaced apart (from center to center) by approximately 40 μm.

A computer 17, which is connected to the print head 6 and the device 8 by lines 18, controls the two units 6, 8. The print head 6 is actuated in accordance with the image to be printed or in accordance with corresponding data. The device 8 is preferably actuated with data or patterns that exhibit anisotropy or create anisotropy as they are processed.

Figure 2A:
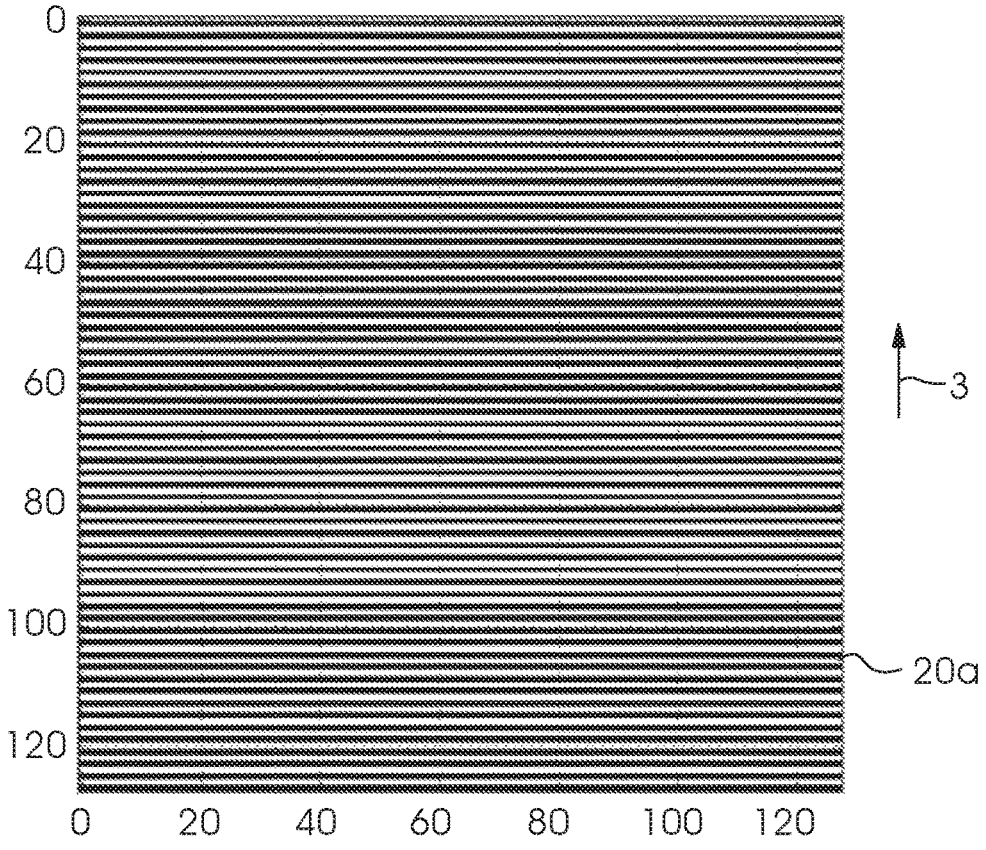
FIGS. 2A to 2C are illustration showing anisotropic patterns for influencing a spreading behavior in accordance with the invention.
Figure 2B:
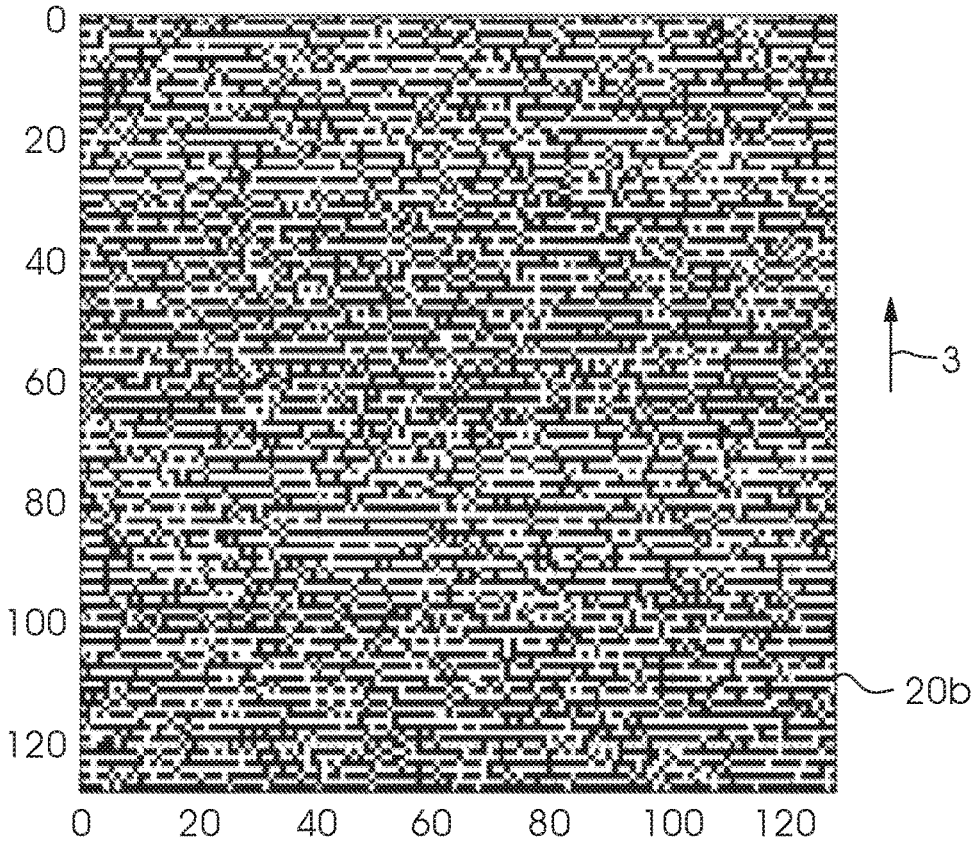
Figure 2C:
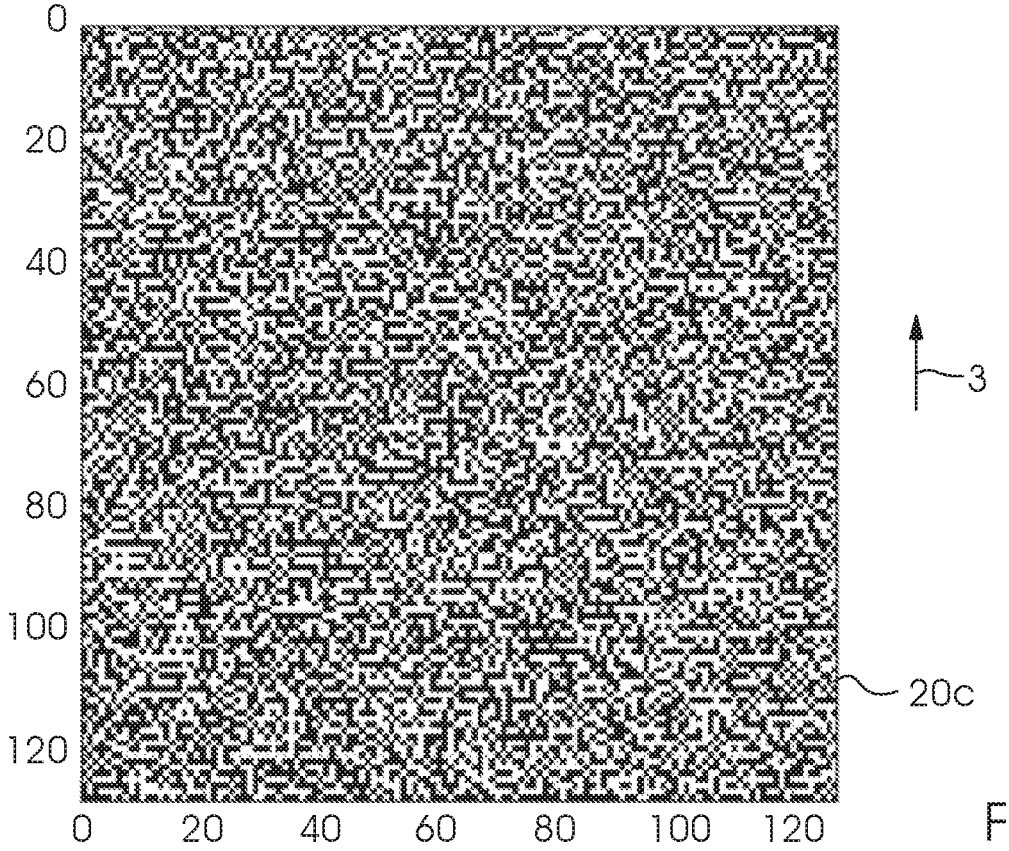

FIGS. 2A and 2C illustrate anisotropic patterns for influencing the spreading behavior in accordance with the invention. Such patterns may be made available to the device 8 in a way similar to a print image. If the device 8 is a print head 8*a*, the print head 8*a* may apply the respective pattern to the printing material as an anisotropic structure 10.

FIG. 2A illustrates an anisotropic pattern composed of parallel lines, preferably lines of equal width and equal spacing. The line spacing (from line center to line center) may in particular be approximately 5 μm.

FIGS. 2B and 2C illustrate patterns that are the result of additionally superposing white noise to the pattern of FIG. 2A. The white noise hides the anisotropy of the patter, preferably preventing any anisotropic structures visible to the naked eye from being created on the printing material. The pattern may for instance be created as a bitmap with arbitrary numbers between 0 and 255, to which a cosine of a wavelength of 2 bitmap lines is added, for example (corresponds to the anisotropy). To conclude, a threshold operator may be applied to the bitmap, resulting in a bitmap containing only zeros or ones: Zeros for a cell value between 0 and 127 and ones for a cell value between 128 and 256.

The following is a summary list of reference numerals and the corresponding structure used in the above description of the invention:

1 printing material
1*a* first region
1*b* second region
2 side edges
3 direction of transport
4 transverse direction
5 longitudinal direction
6 ink print head
7 nozzles
7*a* nozzles that are printing
7*b* failed nozzles
7*a* nozzles that are printing
7*b* failed nozzles
8 device for pretreating the printing material
8*a* print head for treatment liquid
8*b* embossing or printing device
8*c* plasma/corona device or laser
9 nozzles
10 anisotropic structure
11 liquid
12 embossed/printed/plasma/corona/laser structure
13 ink print dots
14 white line
15 ink print dots
16 closed white line
17 computer
18 conduit
20*a*-20*c* anisotropic pattern

The invention claimed is:

1. A method for pretreating a printing material used in ink jet printing to influence a spreading of ink print dots on the printing material, which comprises the step of:

influencing a spreading behavior such that the ink print dots spread in an anisotropic way.

2. The method according to claim 1, which further comprises influencing the spreading behavior by an anisotropic application of a liquid to the printing material.

3. The method according to claim 2, which further comprises selecting the liquid from the group consisting of a primer and a varnish.

4. The method according to claim 1, which further comprises influencing the spreading behavior by an anisotropic embossment or print on the printing material.

5. The method according to claim 1, which further comprises influencing the spreading behavior by performing an anisotropic treatment of the printing material with charged particles or with electromagnetic radiation.

6. The method according to claim 1, which further comprises influencing the spreading behavior such that a transverse spreading behavior in a direction perpendicular to a side edge of the printing material is increased relative to a longitudinal spreading behavior in a direction parallel to the side edge.

7. The method according to claim 6, which further comprises aligning the side edge to be parallel to a direction of transport of the printing material.

8. The method according to claim 1, which further comprises influencing the spreading behavior such that a transverse spreading behavior in a direction perpendicular to a side edge of the printing material is reduced relative to a longitudinal spreading behavior in a direction parallel to the side edge.

9. The method according to claim 1, which further comprises influencing the spreading behavior such that a longitudinal spreading behavior in a direction parallel to a side edge of the printing material is increased relative to a transverse spreading behavior in a direction perpendicular to the side edge.

10. The method according to claim 1, which further comprises influencing the spreading behavior such that a longitudinal spreading behavior in a direction parallel to a side edge of the printing material is reduced relative to a transverse spreading behavior in a direction perpendicular to the side edge.

11. The method according to claim 1, which further comprises achieving an influencing of the spreading behavior by an anisotropic embossment or a flexographic print on the printing material.

12. The method according to claim 1, which further comprises achieving an influencing of the spreading behavior by performing an anisotropic treatment of the printing material with charged particles with a plasma or corona, or with laser radiation.

* * * * *